United States Patent [19]

Barr et al.

[11] 3,946,575

[45] Mar. 30, 1976

[54] ECONOMIZER KIT FOR AIR CONDITIONING SYSTEMS

[76] Inventors: Russell L. Barr, 10803 El Arco Drive, Whittier; Samuel J. Affronte, 11951 Easy Way, Garden Grove, both of Calif. 90603

[22] Filed: Jan. 24, 1975

[21] Appl. No.: 543,900

[52] U.S. Cl. ..... 62/176; 62/262; 62/419; 98/33 R; 62/180; 236/49

[51] Int. Cl.[2] ..... F25D 17/04

[58] Field of Search ..... 62/176, 262, 419, 180; 98/33 R, 33 A

[56] References Cited

UNITED STATES PATENTS

| | | | |
|---|---|---|---|
| 1,938,833 | 12/1933 | Irons | 98/33 A |
| 2,218,468 | 10/1940 | Haines | 62/176 |
| 2,628,480 | 2/1953 | Feinberg | 62/176 |
| 3,789,621 | 2/1974 | Inuzuka | 62/262 |

*Primary Examiner*—William J. Wye
*Attorney, Agent, or Firm*—J. C. Baisch

[57] ABSTRACT

An economizer kit for attachment to the outside of a return air duct of air conditioning systems. The kit comprises what is termed a housing having end walls and side walls which define a conduit open at both ends. At one end of the conduit, there is a by-pass passage formed by two chambers that under certain operating conditions are in open communication with each other but under other operating conditions, are separated by a movable damper, one of these chambers is an inlet chamber for air from the return air duct of the air conditioning system, while the other chamber is an outlet chamber for air returning to the return air duct. At the opposite end, the conduit has a partition extending longitudinally part-way in the conduit thus deviding the conduit into an outlet passage for air from the inlet chamber and an inlet passage adapted to communicate with the outlet chamber. The outlet passage discharges to ambient atmosphere and the inlet passage receives ambient atmospheric air. There is a pivoted damper movable between a position closing the inlet air passage and a position separating the inlet and outlet chambers, the inlet passage being normally closed by the damper.

6 Claims, 5 Drawing Figures

ECONOMIZER KIT FOR AIR CONDITIONING SYSTEMS

There is a reversible electric motor connected to the pivoted damper for actuating same between the two positions above described and there are a plurality of normally closed pivoted louvers controlling the connection between the inlet chamber and the outlet passage, said louvers being closed by gravity and openable by air pressure above a pre-determined value in the inlet chamber. Means for controlling the electric motor and the refrigeration apparatus is controlled by a temperature and humidity sensing device operably exposed to atmospheric air. To incorporate the present invention, in an existing air conditioning system, two openings are cut into the return air duct and a partition installed in the return air duct between the two openings. The economizer kit is then attached to the return air duct by any suitable means such as screws or the like with the inlet chamber in communciation with the opening upstream of the partition and the outlet chamber in communication with the return air duct downstream of the partition. Under normal operating conditions, when the ambient atmospheric air is warmer than the desired temperature for the air in a building or building area, the damper is in the position closing the inlet passage. Return air in the return air duct then passes into the inlet chamber and thence into the outlet chamber and then into the return air duct downstream of the baffle in the return air duct. Should the temperature of the ambient atmospheric air drop below the temperature and humidity desired for the building area, the temperature and humidity sensing device energizes the reversible electric motor to effect its moving the damper to the position cutting off communication between the inlet chamber and the outlet chamber. Ambient atmospheric air or a portion thereof is then drawn into the return air duct downstream of the partition therein by way of the inlet passage and the outlet chamber of the economizer unit. The pressure of air in the return air duct upstream of the partition therein increases sufficiently to force open the louvers so that air in said inlet chamber is discharged to ambient atmosphere by way of the outlet passage of the economizer unit. A fan may be added for air relief under certain circumstances. Should ambient atmospheric temperature and humitity raise to the value above the predetermined level, the temperature and humidity sensing device will effect energizing of the reversible electric motor to return the damper to a position closing the inlet passage. The inlet and outlet chambers are then in open communication and the return air of the air conditioning system then by-passes the partition in said return air duct.

SUMMARY OF THE INVENTION

This invention comprises an economizer kit for attachment to the return air duct of air conditioning systems, including existing systems. Two openings are cut in the return air duct and a baffle installed in the duct between the two openings. The refrigeration apparatus is located downstream of the baffle and is of any wellknown electrically operated type either modulating or 2-position. The kit is attached to the outer side of the return air duct and comprises a housing that spans said openings. The housing defines a conduit open at its ends, one end of said conduit having a by-pass comprising an inlet chamber and an outlet chamber in side by side relationship and normally in full open communication with each other. When the present device is attached to the return air duct, the inlet chamber is in alignment and communication with the opening in the return air duct upstream of the baffle and the outlet chamber is in full communication with the opening in the return air duct downstream of the baffle therein.

The other end of the conduit has a longitudinally extending partition providing an outlet passage from the inlet chamber to ambient atmosphere and an inlet passage from ambient atmosphere to the outlet chamber.

There is automatic means for normally closing the outlet passage, this means comprising a plurality of horizontally pivoted louvers moved to the closing position by gravity and opened by air pressure above a pre-determined value in the inlet chamber.

The inlet passage of the conduit is normally closed by a movable damper pivoted for movement between this position and a position separating the inlet and outlet chambers and shutting off air flow therebetween. A reversible electric motor is operably connected with the damper and said motor is controlled by temperature and humidity sensitive means, said means being well known.

Under normal conditions requiring refrigeration apparatus for cooling air for the air conditioning system, that is when the temperature and humidity of outside or abient atmospheric air is above a desired building area temperature and humidity, the damper closes the inlet air passage or a portion thereof. Air flow through the return air duct by-passes the baffle by entering the inlet chamber through the opening upstream of the baffle, passing through the opening downstream of said baffle, thence through the refrigerating unit and thence into the building area being air conditioned.

The refrigeration apparatus includes a compressor and a fan for moving air through the condenser and a second fan for moving the air through the duct system. Should the temperature and humidity of outside or ambient atmospheric air drop below that desired for the building area being air conditioned, the temperature and humidity sensitive means will cause the reversible electric motor for the damper to operate to move the damper to the position whereat it shuts off communication or a portion thereof between the inlet and outlet chambers and at the same time opens the inlet passage. Outside air is then drawn into the outlet chamber by the indoor fan of the refrigeration apparatus which continues to operate and thence into the return air duct downstream of the baffle. The air pressure in the building area being air conditioned will then increase and this increased pressure will be reflected in higher air pressure in the returned air duct upstream of the baffle and in the inlet chamber to escape to ambient temperature. An exhaust fan may be added for air to escape under certain circumstances. Thus, ambient atmospheric air is used to provide cool air to the building area and reduce the refrigeration apparatus running time so air conditioning operating coats are reduced with substantial savings. It is to be understood that with this arrangement, the refrigeration apparatus will operate only part of the time as required by the indoor thermostat. Upon increase in temperature and humidity of ambient atmospheric air, the temperature and humidity responsive means causes the damper motor to operate in the reverse direction to return the damper to its normal position closing the inlet passage.

BACKGROUND OF THE INVENTION

1. Field of the Invention

This invention relates generally to air conditioning systems and relates more particularly to a kit for installation in the system whereby air flow through a part of the system may be controlled for providing cool outside or ambient atmospheric air for conditioning the space serviced by the air conditioning system in lieu of running the refrigerator unit to recool the warn air within the building space being air conditioned.

2. Description of the Prior Art

Heretofore, as far as we are aware, there is no kit or apparatus that can be attached to the outside of an existing air conditioning systems for controlling the introduction of cool outside or ambient atmospheric air into the system when said outside air is cool enough to provide the desired temperature within the area being serviced by the air conditioning system. Units generally on the market are generally an integral part of the air conditioning unit or system itself and to install one of these on an existing air conditioning system requires a major change in the air conditioning unit or the duct work.

OBJECTS AND ADVANTAGES OF THE INVENTION

It is an object of the invention to provide a kit, which in effect, is an economizer kit for air conditioning systems, where power can be saved by using cooler outside air for air conditioning a building space in lieu of running the compressor to recool the warm air from within.

It is another object of the invention to provide a kit of this character which is a self-contained device or apparatus that can be attached to the return air duct of existing air conditioning systems.

It is still another object of the invention to provide a device of this character that may be installed on the sides, top or bottom of a horizontal duct, or a vertical duct.

It is still another object of the invention to provide a kit of this character that comprises a pre-fabricated unit that is easily attached to the return air duct of air conditioning systems.

It is a further object of the invention to provide a device of this character having a by-pass damper that allows the air to recirculate in the standard manner as originally designed or to close off the return air opening and drawer in 100 percent of outside air or a percentage thereof to cool the conditioned space and to automatically relieve the building pressure through a second duct opening.

A still further object of the invention is to provide a device of this character that is simple in construction and operation.

Another object of the invention is to provide a device of this character that is relatively inexpensive to manufacture.

It is still another object of the invention to provide a device of this character that is easy and inexpensive to install into existing air conditioning duct systems.

The characteristics and advantages of the invention are further sufficiently referred to in connection with the following detailed description of the accompanying drawings, which represent one embodiment. After considering this example, skilled persons will understand that many variations may be made without departing from the principles disclosed and I contemplate the employment of any structures, arrangements or modes of operation that are properly within the scope of the appended claims.

BRIEF DESCRIPTION OF THE DRAWINGS

Referring to the drawings, which are for illustrative purposes only.

DESCRIPTION OF THE PREFERRED EMBODIMENT

Figure 1:
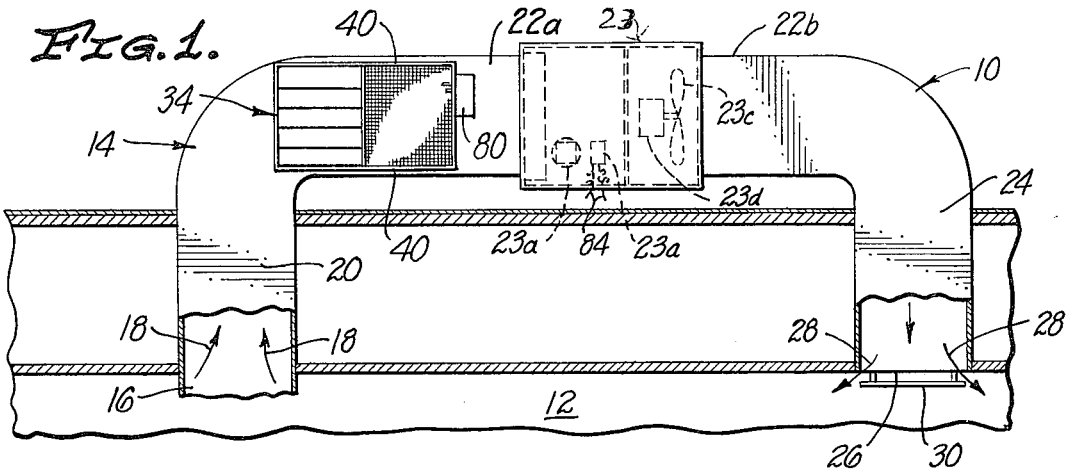
FIG. 1 is a schematic view partly in section, showing an air conditioning system with the present invention operably installed on the return air duct in a horizontal position.
Figure 2:
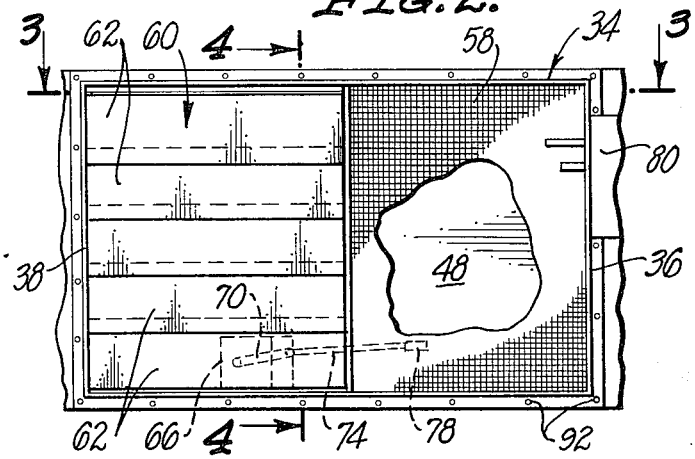
FIG. 2 is an enlarged view of the device as viewed from the outer end.

Referring more particularly to the drawings, there is schematically shown an air conditioning system indicated generally at 10, for a building area or room 12. The air conditioning system has a duct 14 that takes air from the building area 12 through an inlet portion 16. The air taken into this inlet portion is termed return air and the flow thereof is indicated by the arrows 18.

As shown, the inlet part 20 of the duct 14 is vertical and said duct has a horizontal part 22a, which is connected with an electric or gas air conditioning unit 23. This unit includes the usual compressor and electric motors therefore indicated respectively at **23*a* and 23*b*. There is also the usual condenser fan 23*c* driven by electric motor 23*d*. Air cooled by the refrigeration air conditioning unit is discharged into a duct 22*b* which is horizontal and the horizontal part 22*b* is downturned as at 24 and air is discharged at the outlet end 26 of the part 24 as indicated by the arrows 28. A difuser 30 is provided at the oulet end 26** for causing the discharged air to be spread as it enters the building area.

Under normal operating conditions, warm air from the building area is taken into the inlet opening 16 of the part 20 of duct 14 and flows through the duct part **22*a* into the refrigeration unit where it is cooled and discharged through the duct parts 22*a* and 24** from whence the cool air is discharged into the building area as described above.

Figure 3:
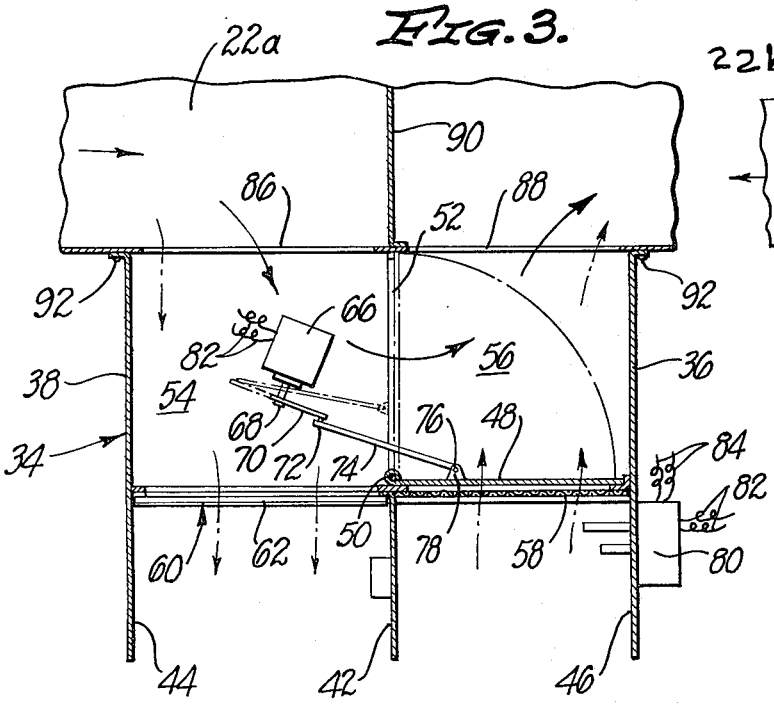
FIG. 3 is a sectional view taken on line 3—3 of FIG. 2.

The present economizer kit, indicated generally at 34, is shown in FIG. 1 as being attached horizontally to the horizontal portion **22*a* of the duct 14. This kit comprises a housing of sheet metal or any other suitable material and said housing has end walls 36 and 38 and side walls 40. A partition 42 within the housing defines, with adjacent portions of the end and side walls, an outlet passage 44 to ambient atmosphere or outside air and an inlet passage 46 with other adjacent portions of the end and side walls. Partition 42 extends part-way into the housing and there is a movable damper 48 having a pivotal axis 50 adjacent the inner end of partition 42, said damper being movable between a position closing the inlet 46 to the entrance of atmospheric air and a position whereat it closes the inner portion of the housing to the flow of air therethrough. As shown in FIG. 3, the damper is in the horizontal position when closing the inlet 46 against the entrance of ambient atmospheric air. When in the other position, the damper 48 is vertical as indicated at 52, and forms a partition dividing the inner end of the housing into a pair of chambers indicated respectively at 54 and 56. A screen 58 is disposed at the outer side of the damper 48** when in the horizontal position and serves as a filter for filtering out foreign particles in the air.

Figure 4:
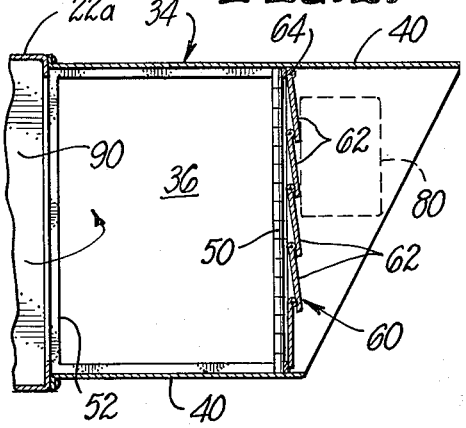
FIG. 4 is a sectional view taken on line 4—4 of FIG. 2.

Means for automatically relieving building pressure under certain circumstances, which will be described hereandafter, comprises a plurality or barometric louvers, indicated generally at 60 and installed within the housing in substantial alignment with the damper when the latter is in its horizontal position. Means indicated generally at 60 is provided for automatically relieving building pressure under operating conditions that will be described hereandafter. This means comprises a plurality of louvers 62 arranged horizontally and mounted within the housing for pivotal movement on pivots 64 at their upper edges. Lower edge portions of the louvers, overlap the pivoted edges of adjacent louvers as best shown in FIG. 4. Louvers 62 close automatically by gravity but when air pressure in chamber 54 raises above a pre-determined value, said pressure forces the louvers to swing outwardly and upwardly to effect discharge of air into ambient atmosphere. As soon as the pressure in chamber 54 drops below a predetermined value, the louvers will automatically move to the closed position. Means as provided for actuating the damper 48 between the two portions here and above described and said means comprises a reversible electric motor 66 installed within the housing by any suitable means, said reversible electric motor has a shaft 68 to which an arm 70 is attached. The outer end of lever 70 has a pivotal connection 72 with one end of a link 74, the opposite end of said link having a pivotal connection 76 with an ear 78 secured to the damper by any suitable means such as welding, brazing or the like. Ear 78 is adjacent to but spaced from the pivot 50 of the damper and when the motor 66 is operated in one direction, the damper is moved from the horizontal to the vertical position and when operated in the opposite direction, the damper is moved from the vertical to the horizontal position as shown in FIG. 3.

Temperature and humidity sensing and control means 80 is connected by wires 82 to the reversible electric motor 66 for controlling its operation.

The indoor fan may be used to operate to move the air through the system. Alternatively, a separate exhaust fan may be used for this purpose, or to relieve the air from the building.

To install the economizer kit, two openings 86 and 88 respectively are cut in the return air duct part 22*a*, FIG. 1, and a partition 90 put into the duct part 22*a* between the two openings, said partition being secured in the duct by any suitable means such as by spot welding, brazing or the like. This partition separates the openings 86 and 88.

The housing of the kit is secured to the return duct part 22*a* by means of rivets 92 or by any other suitable means. When thus installed, the duct part 22*a* upstream of the partition 90, communicates with the chamber 54 through the opening 86 and the chamber 56 communicates through opening 88 with the duct part 22*a* downstream of the partition 90.

Normally, when a building area or building requires cooling of the air by the refrigeration unit, the movable damper 48 is in the horizontal position, as shown in FIG. 3, shutting out entrance of ambient atmospheric air into the chamber 56. At this time, the louvers 62 are closed and return air from the duct 14 upstream of the partition 90 passes through the opening 86 into chamber 54 from which it flows from chamber 56 and thence through the opening 88 into the duct downstream of the partition 90. This air then flows through the refrigeration unit and is then discharged back into the area to be cooled by way of the outlet end 26 of the air duct.

Should the temperature of the ambient atmospheric air drop below the temperature and humidity desired in the building area being conditioned, this outside air may be circulated through the system with or without operation of the refrigerator unit. The temperature and humidity control mechanism 80 will effect operation of the motor 66 to move the movable damper 48 to the vertical position, as shown in FIG. 3, to shut off the flow of air between the chambers 54 and 56 and allow ambient atmospheric air to enter the inlet passage 46 to flow into the chamber 56 and thence through the opening 88 and into the return air duct which carries the outside air for discharge through the outlet 26 of the return air duct and thence into the building area. Air pressure in the return air duct upstream of the partition 90 and in the chamber 54, effects opening of the barometric louvers 62 so that this air will be discharged through the outlet passage 44 to ambient atmosphere.

Should the ambient atmospheric air increase in temperature and/or humidity, the control device 80 will cause the motor 66 to operate in a reverse direction to move the movable damper 48 back to the horizontal position as shown in FIG. 3.

It is to be noted that both temperature and humidity are factors in air conditioning or building areas and the control device 80 senses both temperature and humidity and controls the motor 66 and hence the movable damper 48 and the refrigerator unit in accordance with both temperature and humidity of the outside or ambient atmospheric air.

The arrangement shown in FIGS. 1 – 4 inclusive show the economizer mechanism in the horizontal position and attached to the horizontal part of the return air duct.

Figure 5:
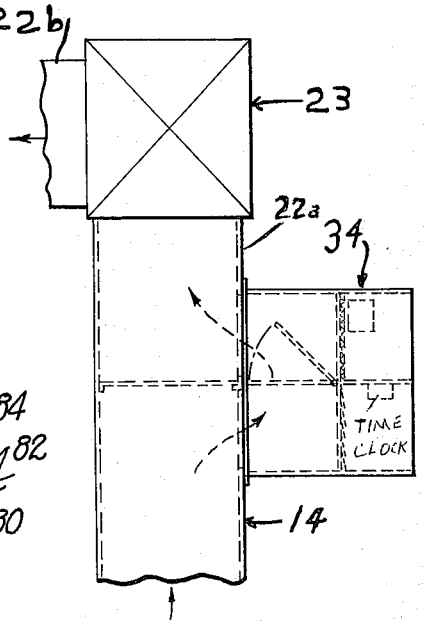
FIG. 5 is a schematic view showing the device installed in a vertical position.

In FIG. 5, the economizer mechanism is shown attached to a vertical part of the return air duct. However, the functioning of the mechanism is the same as above described in connection with arrangements shown in FIGS. 1 – 4 inclusive.

The invention and its attendant advantages will be understood from the foregoing description and it will be apparent that various changes may be made in the form, construction and arrangement of the parts without departing from the spirit and scope thereof or sacrificing its material advantages, the arrangement hereinbefore described being merely by way of example and I do not wish to be restricted to the specific form shown or uses mentioned except as defined in the accompanying claims.

We claim:

1. An energizer kit for air conditioning systems, comprising:

a housing having end walls and side walls said housing defining a conduit open at its ends;

a partition in an outer end portion of said conduit, said partition extending longitudinally part-way into the conduit to define with adjacent side walls and end walls respectively and inlet passage from ambient atmosphere and an outlet passage to ambient atmosphere, the opposite end of said conduit being a by-pass passage one part of which comprises an inlet chamber and the other part comprising an outlet chamber;

a movable damper within the housing;

pivot means for said damper, after pivot means being located at the inner end of the partition;

means for pivotly actuating the damper between a position closing the inlet passage and a position separating the inlet and outlet chambers of the by-pass passage;

normally closed means between the outlet passage to ambient atmosphere and the inlet chamber for automatically relieving pressure in the inlet chamber to atmosphere when the inlet chamber pressure is above a predetermined value;

and temperature control means for controlling the actuating means for the movable damper in accordance with ambient temperature.

2. The invention defined in claim 1, wherein the control means for the actuating means for the movable damper includes humidity responsive means cooperating with the temperature responsive means for controlling the actuating means for the damper.

3. The invention defined in claim 2, wherein the actuating means for the damper comprises a reverisble electric motor operably connected to said damper.

4. The invention defined in claim 3, wherein the means for automatically relieving pressure in the inlet chamber, comprises a plurality of pivoted louvers closed by gravity and opened by pressure in the inlet chamber above a pre-determined value.

5. The invention defined by claim 4 in combination with an air duct having a partition across the duct and having an outlet opening upstream of the partition for the passage of air from the duct into the inlet chamber and having an opening for air flow from the outlet chamber into the duct downstream of the partition.

6. The invention defined in claim 5, wherein there is a refrigeration unit incorporated in the duct downstream of the partition and electrical connecting means between the temperature and humidity control and said refrigeration unit for controlling operation of the refrigeration unit for normal operation under pre-determined temperature and humidity conditions of ambient atmosphere and for shutting off the refrigeration unit when temperature and humidity conditions drop below a pre-determined value while simultaneously controlling the electric motor for actuation of the damper from the position shutting off the conduit inlet passage from ambient atmosphere and the position whereat said ambient atmosphere inlet passage is open and air flow is cut off between the inlet chamber and the outlet chamber.

* * * * *